US006547656B1

(12) United States Patent
LeVine

(10) Patent No.: US 6,547,656 B1
(45) Date of Patent: Apr. 15, 2003

(54) SERRATED KNIFE SHARPENER

(76) Inventor: Arthur L. LeVine, 2116 Rhonda Ter., Henderson, NV (US) 89014

( * ) Notice: Subject to any disclaimer, the term of this patent is extended or adjusted under 35 U.S.C. 154(b) by 103 days.

(21) Appl. No.: 09/688,887

(22) Filed: Oct. 16, 2000

(51) Int. Cl.[7] ..... B24D 15/00
(52) U.S. Cl. ..... 451/524; 451/45; 451/557
(58) Field of Search ..... 451/45, 523, 524, 451/525, 557, 558; 76/82, 82.1, 82.2, 83, 85

(56) References Cited

U.S. PATENT DOCUMENTS

| | | | | | |
|---|---|---|---|---|---|
| 4,197,677 | A | | 4/1980 | Graves | |
| 4,231,194 | A | | 11/1980 | Glesser | |
| 4,751,795 | A | * | 6/1988 | Jenne | 451/461 |
| D316,662 | S | * | 5/1991 | Cherniak | D8/93 |
| D328,847 | S | * | 8/1992 | Button et al. | D8/93 |
| D410,185 | S | * | 5/1999 | Huber | D8/93 |
| 6,048,262 | A | * | 4/2000 | Ray | 451/524 |
| 6,059,645 | A | | 5/2000 | LeVine | |

OTHER PUBLICATIONS

Arthur Lansky LeVine & Associates, Inc. brochure dated 1996—1 page.

* cited by examiner

*Primary Examiner*—Timothy V. Eley
(74) *Attorney, Agent, or Firm*—Joseph P. Gastel

(57) ABSTRACT

A sharpener for a serrated knife having a plurality of ribbed cutting edges interspersed with concave cutting edges, the sharpener consisting of an elongated abrasive sharpening member having a longitudinal axis and a peripheral surface, a ribbed configuration on the peripheral surface extending longitudinally of the longitudinal axis for slidably engaging the ribbed cutting edges, and a convex surface on the peripheral surface extending longitudinally of the longitudinal axis for slidably engaging the concave cutting edges.

18 Claims, 2 Drawing Sheets

SERRATED KNIFE SHARPENER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to an improved sharpener for a serrated knife.

There are serrated knives in existence which have ribbed portions alternating with concave portions on their cutting edges. Insofar as known, in the past there were no sharpeners in existence which could sharpen both the ribbed portions and the concave portions by engaging them individually in complementary mating relationship with a sharpener.

BRIEF SUMMARY OF THE INVENTION

It is one object of the present invention to provide a sharpener for a serrated blade which has a ribbed configuration for positively engaging ribbed configurations of a knife edge in complementary mating relationship.

It is another object of the present invention to provide a knife sharpener having both a ribbed configuration and a convex configuration for engaging ribbed cutting edges and concave cutting edges, respectively, in sharpening engagement. Other objects and attendant advantages of the present invention will readily be perceived hereafter.

The present invention relates to a sharpener for a serrated knife comprising an elongated sharpening member having a longitudinal axis and a peripheral surface, and a ribbed configuration on said peripheral surface extending longitudinally of said longitudinal axis. The sharpener preferably includes a convex surface on its peripheral surface extending longitudinally of said longitudinal axis for engaging concave edge portions of a knife in sharpening relationship.

The various aspects of the present invention will be more fully understood when the following portions of the specification are read in conjunction with the accompanying drawings wherein:

DETAILED DESCRIPTION OF THE INVENTION

Figure 1:
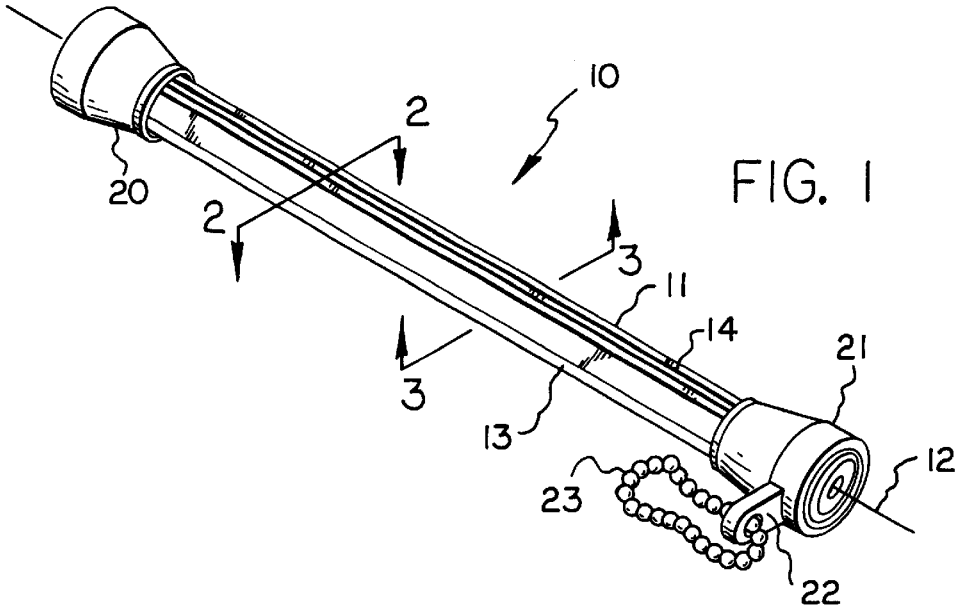
FIG. 1 is a perspective view of one embodiment of the serrated knife sharpener of the present invention.
Figure 4:
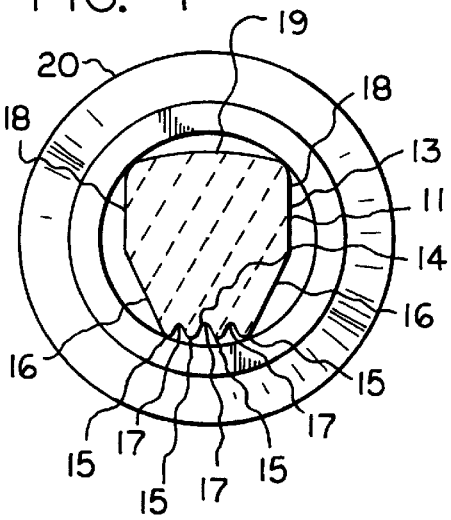
FIG. 4 is a cross sectional view taken substantially along line 4—4 of FIG. 2.
Figure 2:
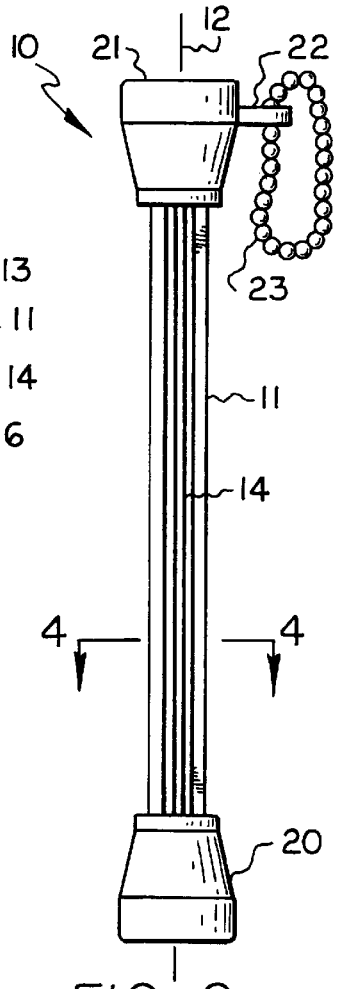
FIG. 2 is a side elevational view taken substantially in the direction of arrows 2—2 of FIG. 1 and showing the ribbed configuration.
Figure 3:
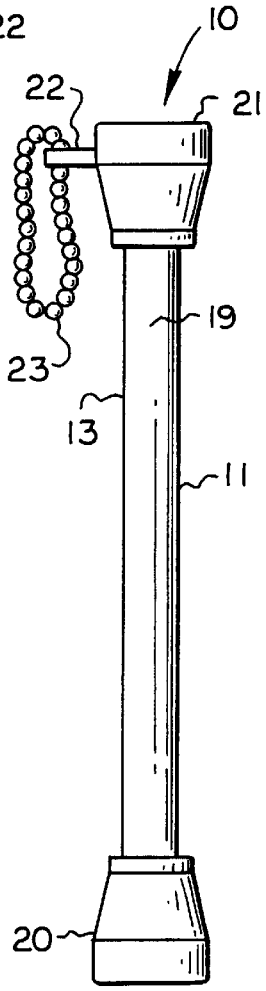
FIG. 3 is a side elevational view taken substantially in the direction of arrows 3—3 of FIG. 1 and showing the convex surface on the elongated sharpening member.

The serrated knife sharpener 10 includes an elongated sharpening member 11 fabricated of a suitable abrasive ceramic material which can sharpen a blade when it is drawn across it. The elongated sharpening member 11 has a longitudinal axis 12 (FIG. 1) and a peripheral surface 13. A ribbed configuration 14 is located on one portion of the peripheral surface 13 and extends longitudinally of the longitudinal axis 12 of the sharpening member 11. Ribbed configuration 14 consists of alternating ribs 15 and valleys 17 (FIG. 4). The elongated sharpening member 11 also includes a convex surface 19 on its peripheral surface 13, and convex surface 19 extends longitudinally of the elongated sharpening member 11. Between the ribbed configuration 14 and the convex surface 19 there are two substantially planar sides 18 which extend throughout the length of the elongated sharpening member 11. Also, as can be seen from FIGS. 4 and 7, the peripheral surface 13 also includes elongated substantially planar sides 16 which are located between substantially parallel edges 18 and ribbed configuration 14.

An end cap 20 is mounted on one end of the elongated sharpening member 11, and an end cap 21 is mounted on the opposite end of the elongated sharpening member. End cap 21 differs from end cap 20 in that it includes a tab 22 having an aperture (not numbered) through which a chain 23 extends. The end caps are made of a plastic material and serve the purpose of protecting the ends of the elongated abrasive ceramic member against chipping and also prevent any sharp edges at the ends of the elongated member 11 from piercing a pocket in which the sharpener 10 may be carried. The sharpener is approximately 4½ inches long so that it can be carried in a pocket. Alternatively, chain 23 may be used to fasten the sharpener 10 to a key ring or to any other suitable body. It will be appreciated that the elongated sharpening member 11 may also be fabricated of metal.

The sharpener 10 is for sharpening a knife 24 (FIG. 5) having a blade 25 with a serrated edge 27. The serrated edge 27 includes ribbed configurations 29 which alternate with concave configurations 30. The ribbed configurations terminate at sharp edges 28. The concave configurations 30 include concave depressions 26 which terminate at concave sharp edges 36 (FIG. 5A).

Figure 5:
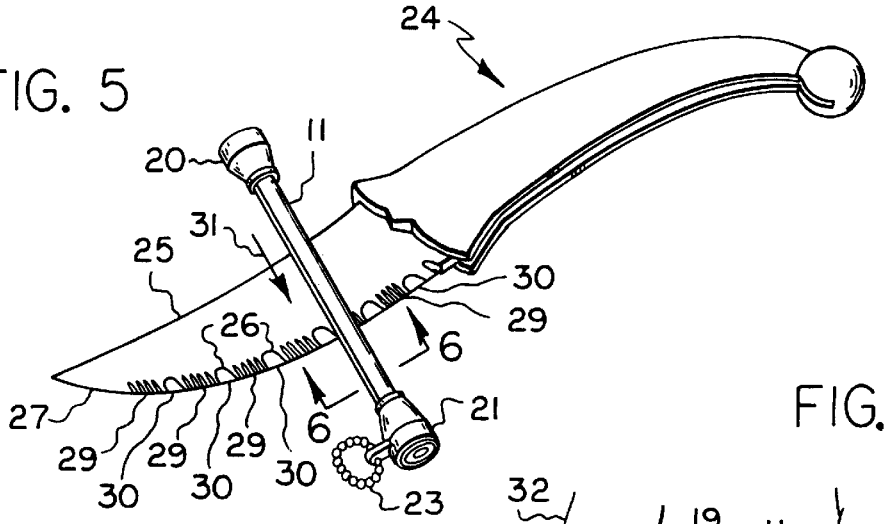
FIG. 5 is a perspective view of a knife having a serrated blade with ribbed portions interspersed with concave portions on the cutting edge.
Figure 6:
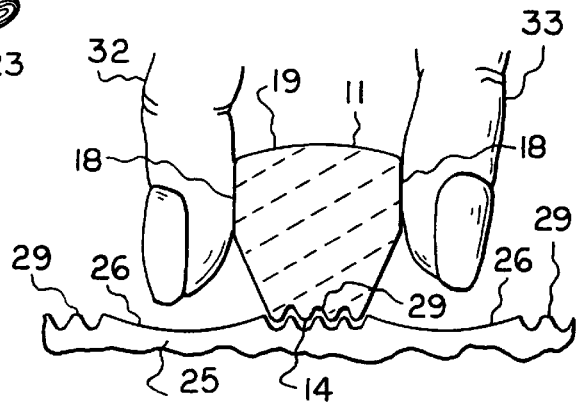
FIG. 6 is a fragmentary cross sectional view taken substantially along line 6—6 of FIG. 5 and showing how the elongated sharpening member engages the ribbed edge of the knife and showing also how it is preferably held between a person's thumb and finger.
Figure 5A:
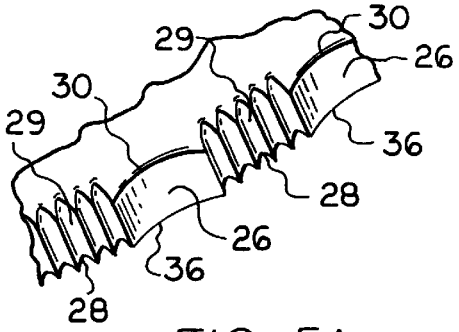
FIG. 5A is a fragmentary enlarged plan view of the cutting edge of the serrated blade of FIG. 5.
Figure 7:
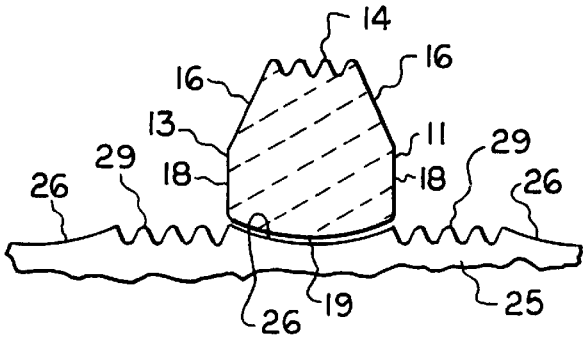
FIG. 7 is a fragmentary cross sectional view similar to FIG. 6 but showing how the convex surface of the elongated sharpening member engages a concave edge portion of the serrated knife of FIG. 5.

The sharpener 10 is used in the manner shown in FIGS. 5–7. The ribbed configuration is of complementary mating shape to the ribbed surface portions 29 of blade 25. To sharpen the edges 28 of ribbed surfaces 29, the elongated sharpening member 11 is positioned with its ribbed configuration in complementary mating relationship with each ribbed edge 29 and drawn across each ribbed surface in the direction of arrow 31 (FIG. 5) to sharpen edge 28 while the substantially planar edges 18 are held between the thumb 32 and a finger 33. In view of the fact that surfaces 18 are substantially planar and parallel to each other, the grasping of these surfaces in the manner noted above, aids in orienting the elongated sharpening member 11 in alignment with each ribbed surface 29 and perpendicular to the edge 28 of each ribbed surface 29 of blade 25. After each edge 28 of the ribbed surfaces 29 is sharpened by drawing the elongated sharpening member 11 across it, the concave edges 36 can be sharpened by placing the convex surface 19 into complementary mating engagement with each concave surface depression 26 and drawing the elongated sharpening member 11 across each concave edge 36 in the direction of arrow 31. Here again, the substantially planar parallel surfaces 18 of the elongated sharpening member 11 are grasped between the thumb and forefinger and the sharpening member 11 is oriented substantially perpendicularly to the edge 27 of the knife.

Figure 8:
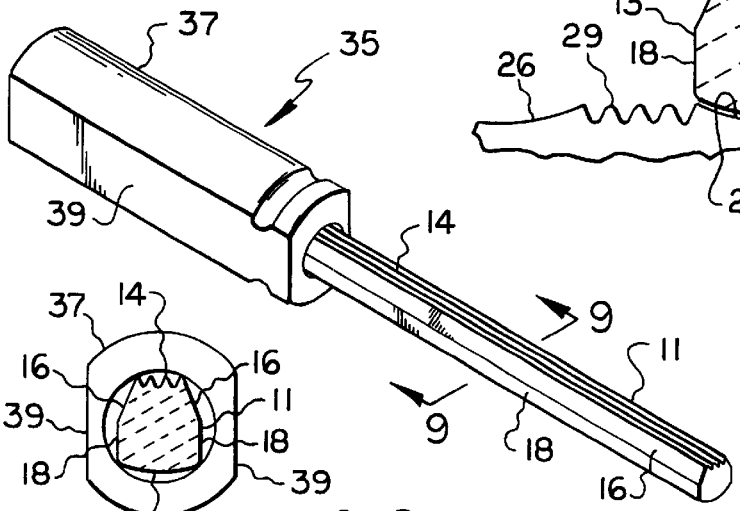
FIG. 8 is a perspective view of the elongated sharpening member of the preceding figures mounted on a handle.
Figure 9:
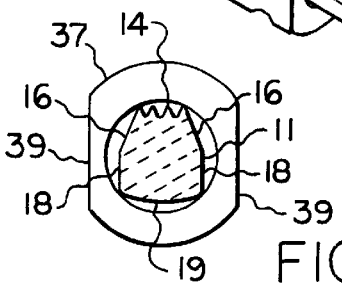
FIG. 9 is a cross sectional view taken substantially along line 9—9 of FIG. 8.

Another embodiment of the present invention is shown in FIGS. 8 and 9. In this embodiment the elongated sharpening member 11 is identical to that described above relative to FIGS. 1–7. However, instead of having end caps, such as 20 and 21, the sharpener 35 has a handle 37 which has substantially parallel planar sides 39 which are substantially parallel to substantially planar parallel sides 18 of sharpening member 11. Sharpening member 11 may be of any desired length, considering that it is not intended to be carried in a pocket as is the embodiment of FIGS. 1–7.

The sharpener 35 of FIGS. 8 and 9 is used in substantially the same manner as described above relative to FIGS. 5–7. In this respect the ribbed surface 14 is placed in complementary mating engagement with each ribbed surface 29 and drawn across the edge 28 thereof. Additionally, the convex surface 19 is placed in engagement with each concave surface depression 26 of blade 25 and drawn across edge 36. The parallel sides 39 of handle 37 are oriented substantially perpendicularly to the edge of knife blade 25 and thus tend to enhance complete contact with both the ribbed edge portions 29 and the concave edge portions 30.

While the above description has been directed specifically to a sharpener for a knife having a cutting edge with alternating ribbed and concave portions, it will be appreciated that the sharpener of the present invention may be fabricated with either only one or more ribbed configurations on its periphery or only one or more convex configurations on its periphery so as to sharpen knives having only a ribbed configuration or a concave configuration, respectively, on its cutting edge.

A model of sharpener 10 has been made which is about 4½ inches long, and the sharpening member 11 has a maximum diameter of about ¼ inch and is made from alumina ceramic. However, it will be appreciated that the sharpening member 11 may have a matrix which includes any suitable type of abrasive including but not limited to silicon carbide, alumina oxide or diamonds. Also, the sharpening member may have a metal, plastic or any other suitable substrate coated with any of the above abrasive materials or any other suitable abrasive material.

While preferred embodiments of the present invention have been disclosed, it will be appreciated that it is not limited thereto but may be otherwise embodied within the scope of the following claims.

What is claimed is:

1. A sharpener for a serrated knife comprising a single elongated sharpening member having a longitudinal axis and a peripheral surface, a ribbed configuration on said peripheral surface extending longitudinally of said longitudinal axis, a convex surface on said peripheral surface extending longitudinally of said longitudinal axis, said ribbed configuration being circumferentially spaced from said convex surface by a circumferential portion of said peripheral surface which is of a different configuration than said ribbed configuration and said convex surface.

2. A sharpener for a serrated knife as set forth in claim 1 including a handle on said single elongated sharpening member.

3. A sharpener for a serrated knife as set forth in claim 1 including ends on said elongated sharpening member, and at least one end cap mounted on one of said ends.

4. A sharpener for a serrated knife as set forth in claim 3 including a second end cap mounted on the other of said ends.

5. A sharpener for a serrated knife comprising an elongated sharpening member having a longitudinal axis and a peripheral surface, a ribbed configuration on said peripheral surface extending longitudinally of said longitudinal axis, a convex surface on said peripheral surface extending longitudinally of said longitudinal axis, said ribbed configuration being circumferentially spaced from said convex surface, and a circumferential portion of said peripheral surface between said convex surface and said ribbed configuration, said circumferential portion being substantially planar.

6. A sharpener for a serrated knife comprising a single elongated sharpening member having a longitudinal axis and a peripheral surface, a ribbed configuration on said peripheral surface extending longitudinally of said longitudinal axis, a convex surface on said peripheral surface extending longitudinally of said longitudinal axis, said ribbed configuration being circumferentially spaced from said convex surface, and a circumferential portion of said peripheral surface between said convex surface and said ribbed configuration, and a second circumferential portion of said peripheral surface which is of a different configuration than said ribbed configuration and said convex surface between said ribbed surface and said convex surface with said ribbed surface being positioned between said circumferential portion and said second circumferential portion.

7. A sharpener for a serrated knife comprising an elongated sharpening member having a longitudinal axis and a peripheral surface, a ribbed configuration on said peripheral surface extending longitudinally of said longitudinal axis, a convex surface on said peripheral surface extending longitudinally of said longitudinal axis, said ribbed configuration being circumferentially spaced from said convex surface, and a circumferential portion of said peripheral surface between said convex surface and said ribbed configuration, and a second circumferential portion of said peripheral surface between said ribbed surface and said convex surface with said ribbed surface being positioned between said circumferential portion and said second circumferential portion, said circumferential portion being substantially planar.

8. A sharpener for a serrated knife comprising an elongated sharpening member having a longitudinal axis and a peripheral surface, a ribbed configuration on said peripheral surface extending longitudinally of said longitudinal axis, a convex surface on said peripheral surface extending longitudinally of said longitudinal axis, said ribbed configuration being circumferentially spaced from said convex surface, and a circumferential portion of said peripheral surface between said convex surface and said ribbed configuration, and a second circumferential portion of said peripheral surface between said ribbed surface and said convex surface with said ribbed surface being positioned between said circumferential portion and said second circumferential portion, said circumferential portion and said second circumferential portion being substantially planar and substantially parallel to each other.

9. A sharpener for a serrated knife comprising a single elongated sharpening member having a longitudinal axis and a peripheral surface, a ribbed configuration on said peripheral surface extending longitudinally of said longitudinal axis, a handle on said single elongated sharpening member, and a convex surface on said peripheral surface extending longitudinally of said longitudinal axis.

10. A sharpener for a serrated knife as set forth in claim 9 wherein said ribbed configuration is circumferentially spaced from said convex surface by a circumferential portion of said peripheral surface which is of a different configuration than said ribbed configuration and said convex surface.

11. A sharpener for a serrated knife comprising an elongated sharpening member having a longitudinal axis and a peripheral surface, a ribbed configuration on said peripheral surface extending longitudinally of said longitudinal axis, a handle on said elongated sharpening member, a convex surface on said peripheral surface extending longitudinally of said longitudinal axis, said ribbed configuration being circumferentially spaced from said convex surface, and a circumferential portion of said peripheral surface between said convex surface and said ribbed configuration, said circumferential portion being substantially planar.

12. A sharpener for a serrated knife comprising an elongated sharpening member having a longitudinal axis and a peripheral surface, a ribbed configuration on said peripheral surface extending longitudinally of said longitudinal axis, a handle on said elongated sharpening member, a convex surface on said peripheral surface extending longitudinally of said longitudinal axis, said ribbed configuration being circumferentially spaced from said convex surface by a circumferential portion of said peripheral surface which is of a different configuration than said ribbed configuration and said convex surface, and a second circumferential portion of said peripheral surface between said ribbed surface and said convex surface with said ribbed surface being positioned between said circumferential portion and said second circumferential portion.

13. A sharpener for a serrated knife comprising an elongated sharpening member having a longitudinal axis and a peripheral surface, a ribbed configuration on said peripheral surface extending longitudinally of said longitudinal axis, a handle on said elongated sharpening member, a convex surface on said peripheral surface extending longitudinally of said longitudinal axis, said ribbed configuration being circumferentially spaced from said convex surface, and a circumferential portion of said peripheral surface between said convex surface and said ribbed configuration, and a second circumferential portion of said peripheral surface between said ribbed surface and said convex surface with said ribbed surface being positioned between said circumferential portion and said second circumferential portion, said circumferential portion being substantially planar.

14. A sharpener for a serrated knife comprising an elongated sharpening member having a longitudinal axis and a peripheral surface, a ribbed configuration on said peripheral surface extending longitudinally of said longitudinal axis, a handle on said elongated sharpening member, a convex surface on said peripheral surface extending longitudinally of said longitudinal axis, said ribbed configuration being circumferentially spaced from said convex surface, and a circumferential portion of said peripheral surface between said convex surface and said ribbed configuration, and a second circumferential portion of said peripheral surface between said ribbed surface and said convex surface with said ribbed surface being positioned between said circumferential portion and said second circumferential portion, said circumferential portion and said second circumferential portion being substantially planar and substantially parallel to each other.

15. A sharpener for a serrated knife as set forth in claim 14 including substantially parallel substantially planar sides on said handle substantially parallel to said circumferential portion and said second circumferential portion.

16. A sharpener for a serrated knife comprising an elongated sharpening member having a longitudinal axis and a peripheral surface, ribbed means on said peripheral surface extending longitudinally of said longitudinal axis for engaging ribbed surface portions of a serrated blade in substantially complementary mating relationship, a convex surface on said peripheral surface extending longitudinally of said longitudinal axis for engaging concave configurations of a serrated blade in substantially complementary mating relationship, and a surface on said peripheral surface which is of a different configuration than said ribbed means and than said convex surface and which extends longitudinally of said longitudinal axis between said ribbed means and said convex surface.

17. A sharpener for a serrated knife as set forth in claim 16 including a second surface on said peripheral surface which is of a different configuration than said ribbed means and than said convex surface and which extends longitudinally of said longitudinal axis between said ribbed means and said convex surface, said surface and said second surface being positioned on opposite sides of said ribbed surface.

18. A sharpener for a serrated knife as set forth in claim 17 wherein said surface and said second surface include planar portions.

* * * * *